United States Patent [19]

Lawson

[11] Patent Number: 4,497,592

[45] Date of Patent: Feb. 5, 1985

[54] SELF-LEVELLING UNDERWATER STRUCTURE

[75] Inventor: John E. Lawson, London, England

[73] Assignee: Armco Inc., Middletown, Ohio

[21] Appl. No.: 326,330

[22] Filed: Dec. 1, 1981

[51] Int. Cl.[3] ..... E02B 17/00; E02D 5/54; E21B 33/047

[52] U.S. Cl. ..... 405/202; 405/195; 405/227; 166/341; 166/366

[58] Field of Search ..... 405/195, 202, 224, 227; 166/341, 366, 368

[56] References Cited

U.S. PATENT DOCUMENTS

| | | | |
|---|---|---|---|
| 3,489,212 | 1/1970 | Rininger | 166/341 X |
| 3,643,446 | 2/1972 | Mott | 405/202 |
| 3,788,396 | 1/1974 | Shatto | 166/341 |
| 3,993,273 | 11/1976 | Dade | 405/195 |
| 4,127,991 | 12/1978 | Regan | 405/202 |
| 4,155,670 | 5/1979 | Stafford | 405/202 |
| 4,212,562 | 7/1980 | Stone et al. | 405/195 |
| 4,408,932 | 10/1983 | Cowan | 405/202 X |

FOREIGN PATENT DOCUMENTS

| | | | |
|---|---|---|---|
| 472518 | 5/1976 | Australia | 405/202 |

*Primary Examiner*—Cornelius J. Husar
*Assistant Examiner*—Nancy J. Stodola
*Attorney, Agent, or Firm*—Roylance, Abrams, Berdo & Goodman

[57] ABSTRACT

A self-levelling underwater structure receivable on an upright support implanted in the floor of a body of water and including a hollow unit fitting over the upright support and having a pivot device thereon engaging the upright support so that the hollow unit gravitates to a level position, and a securing assembly for securing the hollow unit to the upright support in the levelled position. A locking assembly is also provided to prevent relative axial movement of the hollow unit and the upright support once the structure is levelled.

10 Claims, 10 Drawing Figures

SELF-LEVELLING UNDERWATER STRUCTURE

FIELD OF THE INVENTION

The invention relates to an underwater structure, such as a drilling template, a production manifold or a wellhead base, that is levelled on an upright support implanted in the floor of a body of water without the need for separate levelling devices. The underwater structure includes a hollow unit fitting over the upright support so that the hollow unit gravitates to a level position, and securing means for securing the hollow unit to the upright support in the levelled position.

BACKGROUND OF THE INVENTION

In the subsea exploration and production of oil and gas it is highly advantageous to have an underwater structure located adjacent the seabed that is level relative to the surface of the water. The main reason for this is that various additional structures and lines are typically lowered from the surface and are more easily connectable to the underwater structure adjacent to the floor if that underwater structure is level. Examples of such underwater structures are drilling templates, production manifolds, wellhead temporary bases, guide means bases and flowline connector systems.

While prior art devices are known for levelling various structures adjacent to the floor of a body of water, these structures have numerous disadvantages. First, such devices usually require the placement of a plurality of support piles in the floor of the body of water, which is time consuming and expensive. Secondly, many of these prior art devices are dependent on the contour of the floor of the body of water since the structure must engage the floor; however, the floor is usually extremely irregular, thereby merely complicating the levelling activity. Thirdly, many of the prior art devices require complex level indication equipment. Another disadvantage of many of the prior art devices is that they require numerous steps which are time consuming and tie up the use of expensive surface vessels. Finally, many of the prior art levelling devices are capable of levelling only very small structures that cannot support large loads.

A solution to these problems of prior art levelling devices is to provide an underwater structure that is self-levelling; however, none are known to exist. On the other hand, there are self-levelling devices known in other fields which are disclosed in the following U.S. Pat. Nos. 22,378 to Red Head; 1,081,339 to Smith; 1,135,914 to Olesberg; 1,144,591 to Hellman; 1,661,993 to Borda; 1,915,466 to Lilly; 2,037,057 to Bartholomew; 2,161,718 to Miller; and 3,458,940 to Schmued. These patents do not, however, disclose viable systems for levelling underwater structures adjacent to the floor of a body of water.

SUMMARY OF THE INVENTION

Accordingly, a primary object of the invention is to provide an underwater structure that is self-levelling, requiring no separate equipment to provide this function.

Another object of the invention is to provide a self-levelling underwater structure that can be supported on a single pile implanted in the floor of a body of water.

Another object of the invention is to provide a self-levelling underwater structure that levels independently of the floor's contour or condition and does not require complex level indication equipment.

Another object of the invention is to provide a self-levelling underwater structure that accomplishes the levelling operation quickly, thereby avoiding costly surface vessel usage.

Another object of the invention is to provide a self-levelling underwater structure that can support large loads.

The foregoing objects are basically attained by providing in an underwater well structure, the combination of an elongated substantially upright support fixed to the floor of the body of water against lateral and vertical movement and projecting upwardly from the floor; a levelling and supporting unit having an upper end portion, a lower end and a longitudinal axis, the levelling and supporting unit being hollow and having transverse dimensions such that the unit can surround and be spaced outwardly from the upright support at the lower end of the unit and for at least a substantial portion of the length of the unit commencing at the lower end of the unit; a pivot device disposed to coact between the upper end portion of the levelling and supporting unit and the upright support to support the levelling and supporting unit on the upright support with freedom of pivotal movement about all axes transverse to the upright support, the levelling and supporting unit when so supported being free to gravitate to a position in which the longitudinal axis of the unit is vertical whether or not the upright support is vertical; and securing means, engageable between the levelling and supporting unit and the upright support in a location spaced substantially from the upper end of the unit, for securing the unit in its vertical position to the upright support.

In addition, a locking assembly can be provided to lock the levelling and supporting unit to the upright support to prevent relative axial movement therebetween.

Other objects, advantages and salient features of the present invention will become apparent from the following detailed description, which, taken in conjunction with the annexed drawings, discloses a preferred embodiment of the present invention.

DRAWINGS

Referring now to the drawings which form a part of this original disclosure:

DETAILED DESCRIPTION OF THE INVENTION

Figure 1:
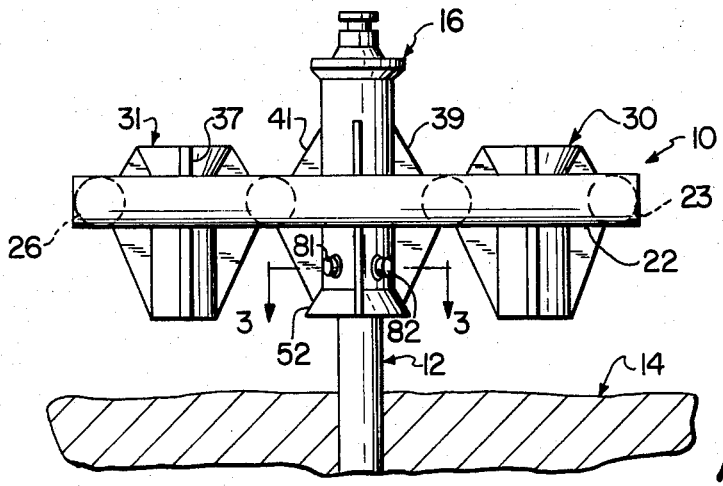
FIG. 1 is a front elevational view of an underwater structure in the form of a template levelled on an upright support in accordance with the invention.

As seen in FIG. 1, an underwater structure 10 in the form of a drilling template is shown levelled on an upright support 12 which is implanted in the floor 14 of a body of water. This structure has been levelled in accordance with the invention regardless of whether the upright support 12 is or is not truly vertical relative to the surface of the water.

Figure 3:
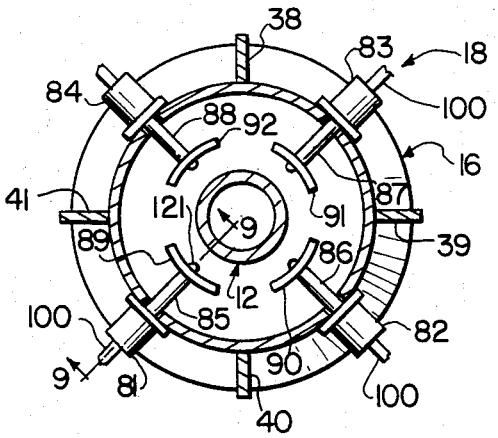
FIG. 3 is a top plan sectional view taken along lines 3—3 in FIG. 1 showing the securing means for securing the levelling and supporting unit to the upright support.
Figure 4:
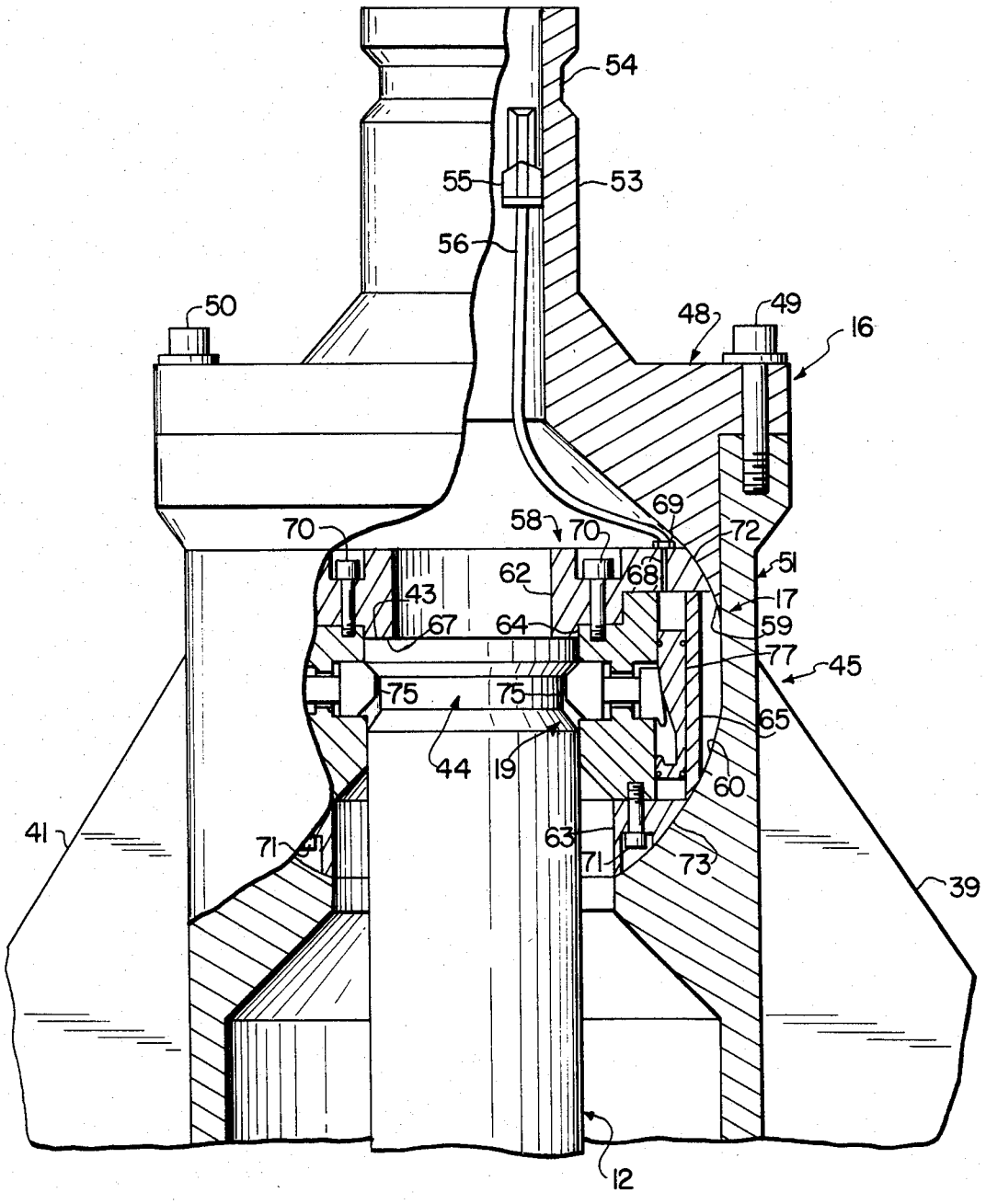
FIG. 4 is an enlarged fragmentary front elevational view in partial section of the levelling and supporting unit shown in FIG. 1, illustrating details of the pivot device and the locking assembly.
Figures 5, 6, 7, 8:
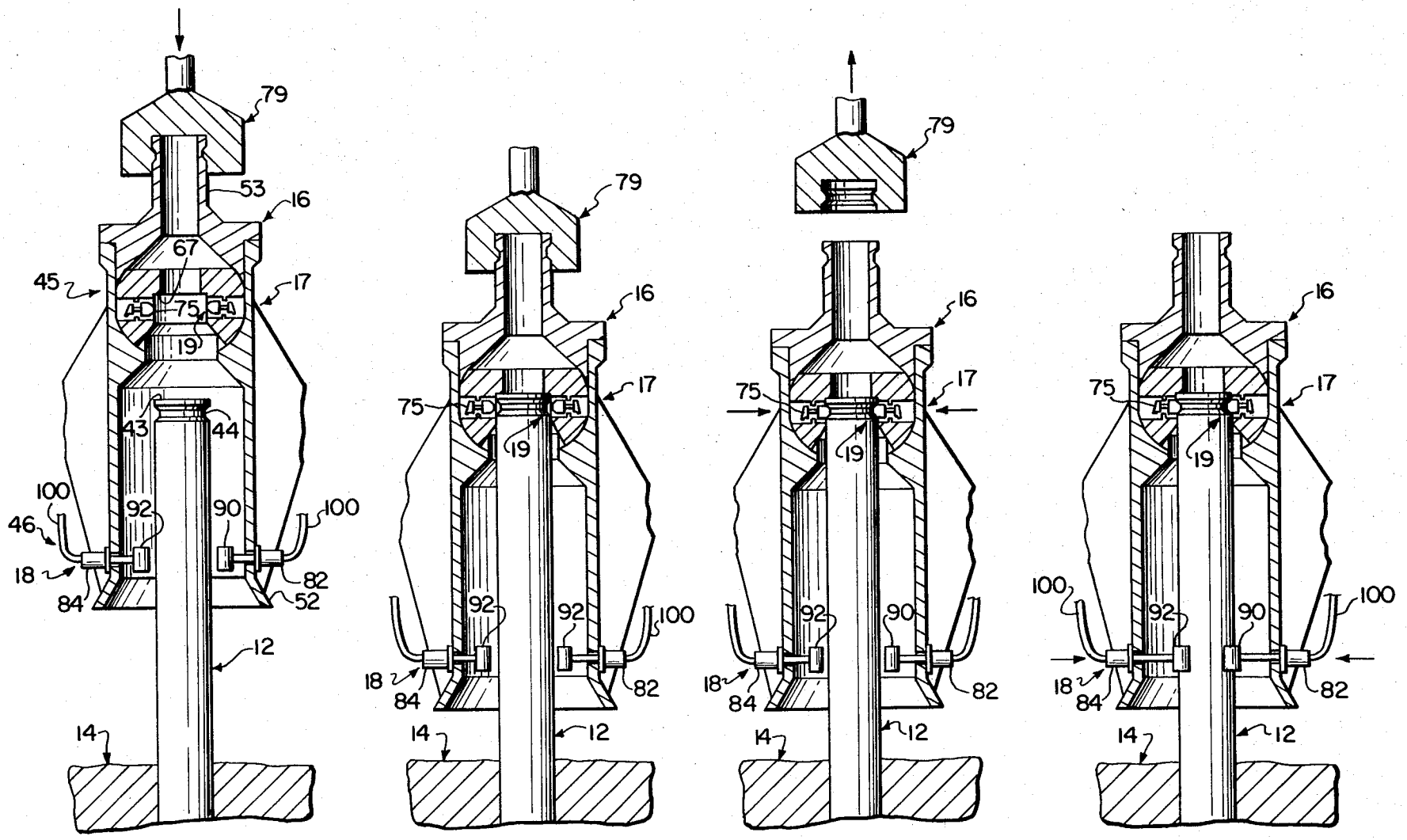
FIG. 5 is a front elevational diagrammatic view of the levelling and supporting unit about to be landed on an upright support.
FIG. 6 is a view similar to that shown in FIG. 5 except that the levelling and supporting unit has been landed on the upright support.
FIG. 7 is a view similar to that shown in FIG. 6 except that the locking assembly has been activated to lock the levelling and supporting unit to the upright support to prevent relative axial movement and the levelling and supporting unit has gravitated to a position in which the longitudinal axis thereof is vertical.
FIG. 8 is a view similar to that shown in FIG. 7 except that the securing assembly near the bottom of the levelling and supporting unit has been activated to secure the levelling and supporting unit to the upright support in a levelled position.

This self-levelling has been accomplished by means of a combination of a levelling and supporting unit 16 rigidly coupled to the underwater structure 10, a pivot device 17 shown in FIG. 4 between the upright support 12 and the levelling and supporting unit 16, and a securing assembly 18 shown most clearly in FIGS. 3 and 5. In addition, a locking assembly 19 shown in FIGS. 4 and 5 has been utilized to lock the levelling and supporting unit 16 to the upright support to prevent relative axial movement.

Figure 2:
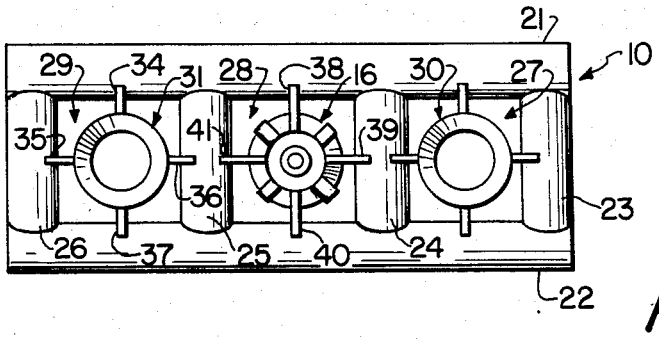
FIG. 2 is a top plan view of the apparatus shown in FIG. 1.

Referring now to FIGS. 1 and 2, the template 10 is the underwater structure used herein to illustrate the invention, although such a structure could also be a production manifold, a wellhead temporary base, a guide means base, a flowline connector system or any other type of underwater structure which is to be levelled adjacent to the floor of a body of water. The upright support 12 is shown as a pile implanted in the floor although it could be any generally upright support such as a surface casing of an existing underwater well. Of course, the upright support cannot reliably be implanted in the floor in a vertical position so that the present invention is necessary to level the underwater structure.

The template is comprised of two parallel-spaced pipes 21 and 22 interconnected by four shorter transverse pipes 23–26 rigidly connected on their opposite ends to pipes 21 and 22. These pipes define three rectangular slots 27–29 with the central slot 28 receiving the levelling and supporting unit 16 therein and the two end slots 27 and 29 receiving two tubular drilling guides 30 and 31 respectively therein. Each of the drilling guides is rigidly supported perpendicular to the template by means of four webs 34–37 rigidly connected thereto and to the template. In a similar fashion, the levelling and supporting unit 16 is rigidly coupled perpendicular to the template in the central slot 28 via webs 38–41 which are rigidly coupled to the unit and to the template pipes 21, 22, 24 and 25.

As best seen in FIG. 4, the upright support 12 is cylindrical and has an upwardly facing annular shoulder 43 at the very top and an annular locking groove 44 on the outer surface having a substantially trapezoidal crosssection.

The levelling and supporting unit 16 as shown in FIGS. 3–8, has an upper end portion 45, a lower end 46 and a longitudinal axis. The unit is hollow and has transverse dimensions such that the unit and the template can surround and be spaced outwardly from the upright support 12 at the lower end of the unit and for at least a substantial portion of the length of the unit commencing at the lower end 46 of the unit. The unit is basically comprised of an upper annular member 48 coupled via bolts 49 and 50 to a lower annular member 51 having a substantially cylindrical outer surface along most of its length except at the bottom where there is an upwardly and inwardly tapering frustoconical flange 52, as shown in FIGS. 4 and 5. As seen best in FIG. 4, the upper annular member 48 has a hollow hub 53 extending upwardly therefrom having an annular locking groove 54 with a trapezoidal cross-section on the outer surface. Inside hub 53 is a conventional female hydraulic stab-in connector 55 having a hydraulic line 56 extending therefrom.

The pivot device 17 is formed from an annular assembly generally indicated at 58 having an outer surface which is a portion of a sphere, and a socket assembly formed by an upper surface 59 in the form of a part of a sphere on the bottom of upper annular member 48 and a lower surface 60 in the form of a part of a sphere formed integrally and extending inwardly of the lower annular member 51 in the levelling and supporting unit 16.

As seen in FIG. 4, the annular assembly 58 is formed from an upper ring 62, a lower ring 63, a central ring 64 between rings 62 and 63 and an outer ring 65. Upper ring 62 has a downwardly facing central annular shoulder 67 which engages upwardly facing shoulder 43 on the top of the upright support 12. This upper ring 62 also has a vertical bore 68 passing completely therethrough which bore is connected via a fitting 69 to hydraulic line 56. The upper ring 62 is connected to the central ring 64 by a plurality of bolts 70 and the lower ring 63 is connected to the central ring by a plurality of bolts 71. As seen in FIG. 4, the outer surfaces 72 of upper ring 62 and 73 of lower ring 63 are formed as portions of a sphere and slidably engaged surfaces 59 and 60, which are also in the shape of a spherical socket, to provide a pivotal support to the levelling and supporting unit on the upright support with freedom of pivotal movement about all axes transverse to the upright support.

The locking assembly 19 is basically comprised of a plurality of locking dogs 75 that are horizontally supported in suitable bores in the central ring 64 for movement radially inwardly into a locking engagement with the locking groove 44 on upright support 12. These locking dogs are moved radially inwardly by means of downward movement of an annular piston 77 received between the outer surface of central ring 64 and the inner surface of outer ring 65. Bore 68 in the upper ring 62 delivers hydraulic fluid to piston 77 from line 56 and connector 55 when a handling tool 79, as seen in FIGS. 5–7, is connected to hub 53, the handling tool having a conventional male hydraulic stab-in connector for connection with female stab-in connector 55. As illustrated in FIG. 4, downward movement of piston 77 biases the locking dogs 75 radially inwardly due to the upwardly and inwardly tapered frustoconical surface on the inside of the piston and a corresponding surface in the form of a cam follower on the outside of the locking dog 75. To release the locking dogs a suitable hydraulic connection can be made to provide hydraulic pressure to the bottom of piston 77, which is then driven upwardly and has an upwardly and inwardly tapering outwardly facing frustoconical surface which engages a similar inwardly facing surface on the locking dog. Such a piston and locking dog combination is conventional and is disclosed in U.S. Pat. No. 3,228,715 to Neilon et al., the disclosure of which is hereby incorporated by reference.

Figure 9:
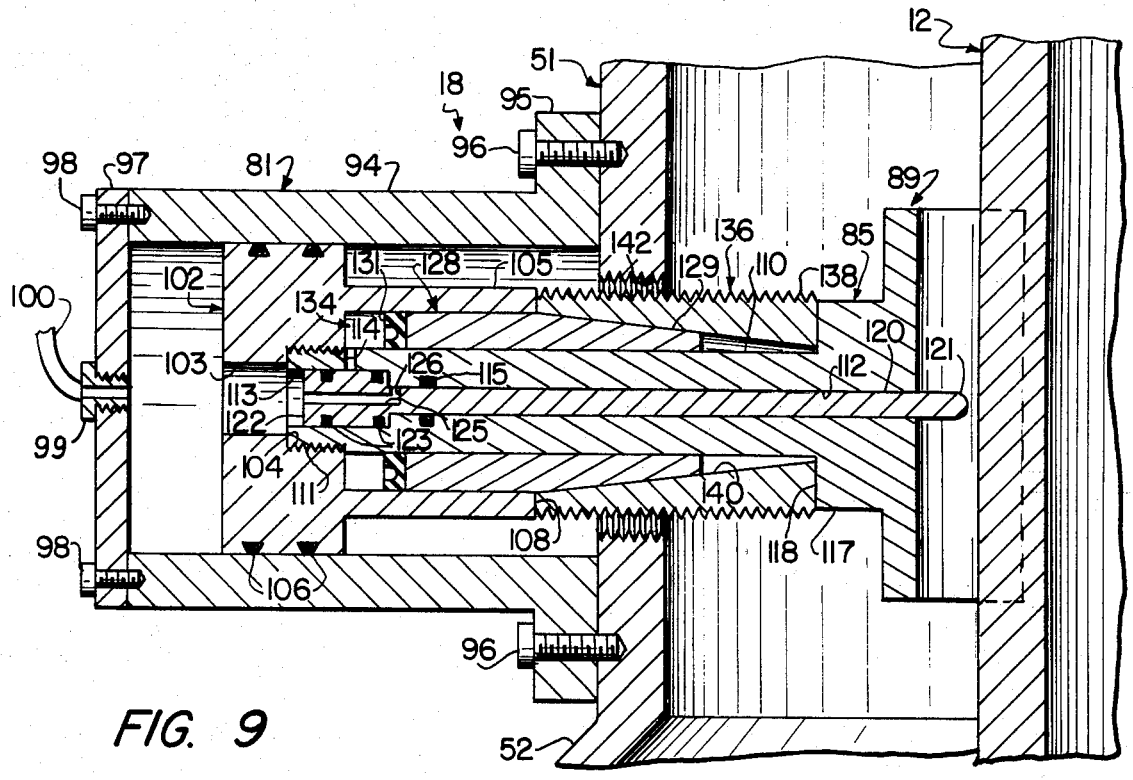
FIG. 9 is an enlarged elevational view in section taken along lines 9—9 in FIG. 3 of one of the members comprising the securing assembly.
Figure 10:
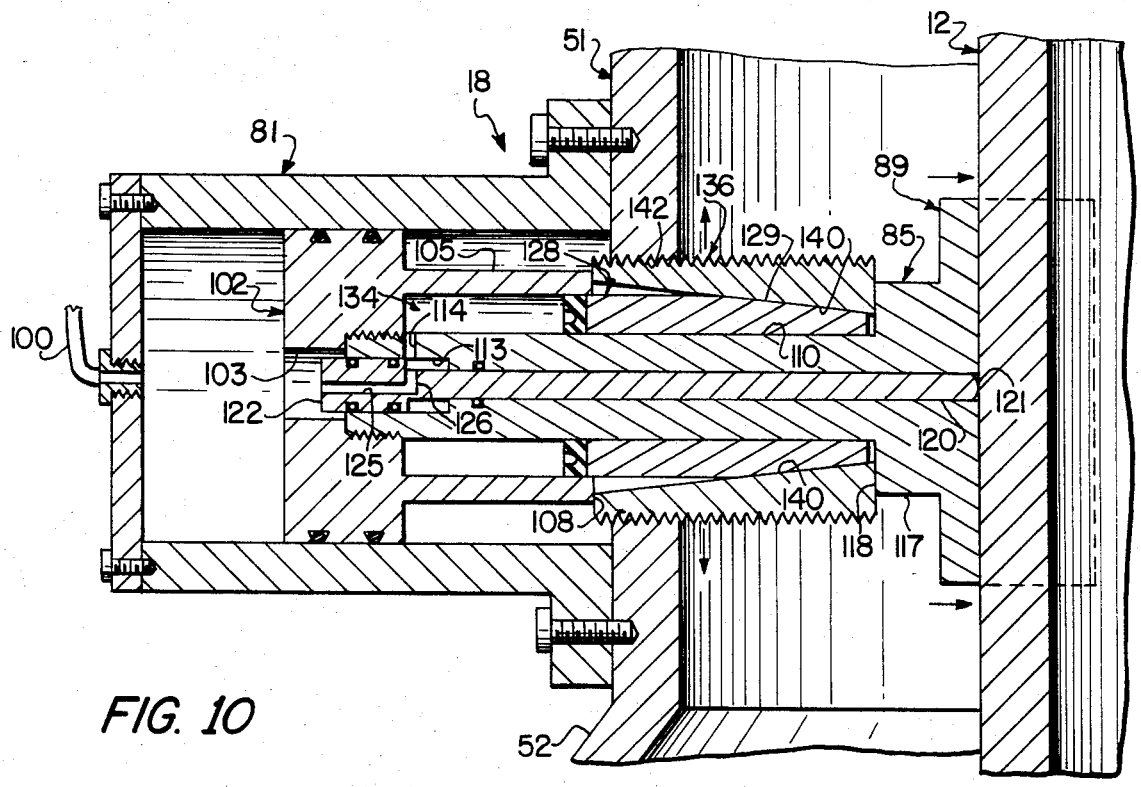
FIG. 10 is a view similar to that shown in FIG. 9 except that the gripping member in the securing assembly has engaged the upright support.

The securing assembly 18 for securing the levelling and supporting unit 16 in its vertical position to the upright support 12 is shown generally in FIGS. 3 and 5–8 and in detail in FIGS. 9 and 10. Basically, this securing assembly 18 comprises four hydraulic cylinders 81–84 rigidly coupled to the outside of the lower annular member 51 in the levelling and supporting unit with a plurality of associated piston rods 85–88 extending therefrom, extending through apertures in annular member 51 and having curved gripping members 89–92 rigidly coupled thereto, these gripping members ultimately engaging the upright support 12.

Referring now to FIGS. 9 and 10, the structure of cylinder 81, piston rod 85 and gripping member 89 is illustrated in detail, the remaining cylinders, piston rods and gripping members being similarly constructed.

Hydraulic cylinder 81 is comprised of an open ended cylinder 94 having an outwardly extending radial flange 95 bolted via bolts 96 to annular member 51 and a disk-shaped cap 97 closing the outer end of cylinder 94 and being coupled thereto by a plurality of bolts 98. This cap 97 has a threaded central aperture for threadedly receiving a hydraulic fitting 99 having a hydraulic line 100 coupled thereto. Preferably, each of the hydraulic lines extending from cylinders 81–84 are connected in a bundle.

Slidably received along the inner cylindrical surface of cylinder 94 is a disk-shaped piston 102 having a central bore 103 extending into the piston from the left hand side, a threaded larger diameter counter-bore 104 extending into the piston co-axially with bore 103 from the right hand side and a cylindrical flange 105 extending axially from the right hand side of the piston. On the exterior cylindrical surface of piston 102 are suitable annular grooves receiving O-ring seals 106 therein. Cylindrical flange 105 has a diameter greater than threaded bore 104 and has an annular end shoulder 108 facing upright support 12.

Piston rod 85 comprises a cylindrical tube 110 having a threaded end 111 threadedly engaging threaded bore 104 in the piston. Tube 110 has a central cylindrical bore 112 extending completely therethrough with a counter-bore 113 of a larger diameter equal to the diameter of bore 103 being formed in the threaded end 111. A radially extending bore 114 passes through the wall of tube 110 from the counterbore 113 into the annular space 134 defined inside cylindrical flange 105 on the piston. Adjacent the end of counter-bore 113 is a radially outwardly directed groove formed inside tube 110 along bore 112 to receive an O-ring seal 115. At the other end of tube 110 is an enlarged cylindrical boss 117 which has an annular shoulder 118 extending towards cylindrical flange 105 and which has the curved gripping member 89 at the end facing the support 12.

Slidably received inside counter-bore 113 and central bore 112 of the piston rod 85 is an actuating rod 120 having a tip 121 at the end adjacent to upright support 12 and an enlarged cylindrical body 122 at the other end, this body being slidably received in counter-bore 113. This body has suitable annular grooves for receiving O-ring seals 123 therein in slidable sealing engagement with counter-bore 113. A central bore 125 extends through the cylindrical body 122 and is intercepted by a radially directed bore 126 which extends to the outer cylindrical surface of rod 120.

Slidably received on the outside of tube 110 and along the inside of cylindrical flange 105 is a generally cylindrical tube 128 having an upwardly and inwardly tapering frustoconical surface 129 on the outer surface adjacent cylindrical boss 117. An annular pressure-activated rubber gasket 131 is interposed between cylindrical flange 105 and tube 110 with an edge abutting the outer end of tube 128. This gasket has an annular recess on the face away from tube 128 so that it is pressure-activated to seal between flange 105, tube 128 and tube 110 when hydraulic fluid enters an annular recess 134 defined by the gasket, the piston, cylindrical flange 105 and tube 110.

A split ring 136 is received between annular end shoulder 108 of the cylindrical flange 105 and annular end shoulder 118 of the cylindrical boss, this split ring having a substantially cylindrical outer surface with serrations 138 thereon. The inner surface 140 of the split ring is an upwardly and inwardly tapering frustoconical surface which is in slidable engagement with frustoconical surface 129 on tube 128. As is evident, when tube 128 is moved towards the upright support 12 the engaging frustoconical surfaces will bias the split ring 136 radially outwardly.

As seen in FIG. 9, the split ring 136 is received in a substantially circular aperture 142 in annular member 51, the surface of this aperture being serrated so that once the serrated outer surface of the split ring engages these serrations on the aperture there will be no relative movement longitudinally therebetween.

OPERATION

To install the underwater structure 10 in the levelled position shown in FIG. 1, the first step is to implant the upright support 12 in the floor 14 in a body of water as illustrated in FIG. 5. This support is implanted in as vertical a position as possible.

Then, the levelling and supporting unit 16, rigidly connected to the remaining parts of the structure 10, is lowered from the surface of the body of water by means of the handling tool 79 releasably coupled to hub 53 as shown in FIG. 5. The levelling and supporting unit 16 is maneuvered downwardly over the upright support 12 with the tapering flange 52 at the bottom helping to receive and center the support relative to the hollow interior of the unit.

The unit 16 is then landed on the top of the upright support 12 with the downwardly facing annular shoulder 67, seen in an enlarged view in FIG. 4, engaging upwardly facing annular shoulder 43 at the top of the upright support 12. This landed position is shown in FIG. 6. As seen in FIG. 6, the locking dogs 75 are in their unlocking position so that the top of the support 12 passes by them. At this time, hydraulic fluid from the handling tool 79 is conducted through hydraulic line 56, seen in FIG. 4, to move piston 77 downwardly and therefore the locking dogs 75 radially inwardly into a locking position with locking groove 44 on the top of support 12, as shown generally and diagramatically in FIG. 7 and in specific detail in FIG. 4.

Next, the handling tool 79 is retrieved upwardly away from unit 16 which is now free to gravitate to a position in which the longitudinal axis of the unit is vertical since the underwater structure including the unit has an even distribution of weight on opposed transverse sides of the longitudinal axis of the unit. This gravitating is allowed by means of the pivot device 17 in the substantical form of a ball and socket, shown in detail in FIG. 4.

In this levelled position, the plurality of hydraulic cylinders 81–84 and their associated piston rods 85–88 are actuated to move gripping members 89–92 into an engaging position with upright support 12 as shown in FIG. 8. Once all of these gripping members engage the upright support, the unit 16 and structure 10 will be secured to upright support 12 in the levelled position. They will also be locked against relative axial movement by means of the engaged locking dogs 75.

Since the hollow interior of the levelling and supporting unit 16 is not equidistant in a radial direction from the upright support, each of the piston rods will not move radially inwardly the same distance. This is accomplished by means of the actuating rods 121 associated with each piston rod which stops radially inward movement of each gripping member when it engages the exterior surface of the upright support.

This occurs because, when the actuating rod tip 121 engages the outer surface of the upright support, the split ring 136, seen in FIGS. 9 and 10, is moved radially outwardly to engage the serrated interior of aperture 142. With this ring 136 locked to the aperture 142, piston rod 85 cannot move further radially inwardly towards the upright support 12 because frustoconical surface 129 engages frustoconical surface 140 on the inside of the split ring 136 and annular shoulder 108 on flange 105 abuts ring 136, this flange being coupled to the piston 102 which is in turn coupled to the piston rod 85.

To initially move the piston rod 85 and gripping member 89 towards the upright support 12, hydraulic fluid via hydraulic line 100 enters cylinder 81 to push piston 102, coupled to rod 85 and gripping member 89, in the radially inward direction. This continues until the tip 121 of rod 120 engages the outer surface of the upright support, as shown in FIG. 10, which displaces rod 120 radially outwardly so that radial bore 126 therein is in fluid flow connection via counter-bore 113 with radial bore 114 in tube 110. Thus, hydraulic fluid can now flow from cylinder 81 through bore 103 in the piston, then into rod 120 and through axial bore 125, through radial bore 126, through counter-bore 113 into radial bore 114 and then into the annular recess 134 between cylindrical flange 105 and tube 110. The hydraulic fluid and pressure thus present in recess 134 pushes tube 128 radially inward of the upright support so that the outer frustoconical surface 129 thereon slidably engages the inner frustoconical surface 140 on split-ring, thereby driving the split ring outwardly into locking engagement with aperture 142. This stops the movement of piston rod 85 towards the upright support 12.

When all of the gripping members engage the outer surface of the upright support, they are all locked in place in a similar manner to keep the unit 16 and structure 10 in the levelled position.

While one advantageous embodiment has been chosen to illustrate the invention, it will be understood by those skilled in the art that various changes and modifications can be made therein without departing from the scope of the invention as defined in the appended claims. For example, the template or other structure 10 could be disposed relative to unit 16 at an angle other than 90 degrees if desired where only unit 16 would be vertically oriented relative to the water surface. In addition, rather than using a ball and socket pivot device, devices such as point pivots, trunnions, chains, cables, resilient members, flat surfaces or cantilever arms can be used to coact with the top of the support 12. Moreover, wedges or pivotal cams can be used to secure the unit 16 to the support 12 in the levelled position as well as individually activated rectilinear power devices utilized with level indication equipment read remotely.

What is claimed is:

1. In an underwater well structure, the combination of an elongated substantially upright support fixed to the floor of the body of water against lateral and vertical movement and projecting upwardly from the floor;

an underwater structure including a levelling and supporting unit having an upper end portion, a lower end and a longitudinal axis, a pivot device disposed to coact between the upper end portion of the levelling and supporting unit and the upright support to support the underwater structure on the upright support with freedom of pivotal movement about all axes transverse to the upright support, the levelling and supporting unit being hollow and having transverse dimensions such that the unit surrounds and is spaced outwardly from the upright support at the lower end of the unit and for at least a substantial portion of the length of the unit commencing at the lower end of the unit;

the underwater structure having an even distribution of weight on opposed transverse sides of the longitudinal axis of the levelling and supporting unit;

the underwater structure, when supported on the upright support gravitating to a position in which the longitudinal axis of the unit is vertical whether or not the upright support is vertical; and securing means engageable between the levelling and supporting unit and the upright support, in a location spaced substantially from the upper end of the unit, for securing the unit in its vertical position to the upright support.

2. The combination according to claim 1, wherein said levelling and supporting unit comprises a substantially cylindrical member.

3. The combination according to claim 1, wherein said securing means is coupled to said levelling and supporting unit.

4. The combination according to claim 1, wherein said pivot device is coupled to said levelling and supporting unit.

5. The combination according to claim 1, wherein said securing means comprises a plurality of hydraulic cylinders coupled to said levelling and supporting unit, each of said cylinders having a piston movable therethrough, each of said pistons having a gripping member coupled thereto for engaging said upright support.

6. The combination according to claim 1, wherein said securing means comprises a plurality of gripping members for engaging said upright support, and means for moving each of said plurality of gripping members into engagement with said upright support.

7. The combination according to claim 6, wherein said means for moving further comprises means for rigidly securing said gripping members to said levelling and supporting unit upon engagement of each of said gripping members with said upright support.

8. The combination according to claim 1, and further comprising locking means, coacting between said upright support and said levelling and supporting unit, for locking said levelling and supporting unit to said upright support to prevent relative axial movement therebetween.

9. The combination according to claim 8, wherein said locking means comprises a plurality of locking dogs, and hydraulic means for moving said locking dogs radially inward into engagement with said upright support.

10. The combination according to claim 8, wherein said locking means is coupled to said pivot device.

* * * * *